US010156162B2

(12) United States Patent
Marsh et al.

(10) Patent No.: US 10,156,162 B2
(45) Date of Patent: Dec. 18, 2018

(54) CAMSHAFT WITH LOW LIFT DWELL PROFILE AND METHODS FOR OPERATING THE SAME

(71) Applicant: Cummins Inc., Columbus, IN (US)

(72) Inventors: Thomas Robert Marsh, Columbus, IN (US); Vaibhav J. Lawand, Greenwood, IN (US); Brendan J. O'Grady, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/145,069

(22) Filed: May 3, 2016

(65) Prior Publication Data

US 2017/0321573 A1 Nov. 9, 2017

(51) Int. Cl.

| | |
|---|---|
| ***F01L 1/34*** | (2006.01) |
| ***F01L 1/08*** | (2006.01) |
| ***F02M 26/04*** | (2016.01) |
| ***F02B 25/14*** | (2006.01) |
| ***F01L 1/053*** | (2006.01) |
| ***F01L 1/18*** | (2006.01) |
| *F01L 13/00* | (2006.01) |

(52) U.S. Cl.

CPC ..... *F01L 1/08* (2013.01); *F01L 1/053* (2013.01); *F01L 1/185* (2013.01); *F02B 25/145* (2013.01); *F02M 26/04* (2016.02); *F01L 13/0005* (2013.01); *F01L 13/0015* (2013.01); *F01L 2001/0537* (2013.01); *F01L 2201/00* (2013.01); *F01L 2800/10* (2013.01)

(58) Field of Classification Search

CPC ... F01L 1/08; F01L 1/047; F01L 1/053; F01L 1/185; F01L 13/0005; F01L 13/0015; F01L 2001/0537; F01L 2201/00; F01L 2800/10; F02M 26/04; F02B 25/145

USPC ..... 123/90.6

See application file for complete search history.

(56) References Cited

U.S. PATENT DOCUMENTS

| | | | | |
|---|---|---|---|---|
| 6,237,559 | B1 | 5/2001 | Russ et al. | |
| 6,910,897 | B2 | 6/2005 | Poola et al. | |
| 7,311,079 | B2 | 12/2007 | Surnilla et al. | |
| 7,819,101 | B2 | 10/2010 | Poola et al. | |
| 8,447,499 | B2 | 5/2013 | Gentile et al. | |
| 8,544,436 | B2 | 10/2013 | Hayman et al. | |
| 2004/0187842 | A1* | 9/2004 | Yang | F01L 1/08 123/322 |
| 2010/0175645 | A1 | 7/2010 | Berger | |
| 2012/0192841 | A1 | 8/2012 | Meldolesi et al. | |

(Continued)

FOREIGN PATENT DOCUMENTS

WO WO2016036936 A1 3/2016

*Primary Examiner* — Zelalem Eshete

(74) *Attorney, Agent, or Firm* — Taft Stetinius & Hollister LLP

(57) ABSTRACT

Systems, apparatus, and methods are disclosed that include an internal combustion engine having a plurality of cylinders and at least one camshaft for opening at least one valve associated with the at least one cylinder. The camshaft includes a cam with a cam lobe defining a cam lobe profile having a base circle portion on a base circle of the cam lobe, a main cam lobe portion, and a low lift dwell portion that extends a constant height from the base circle along a substantial portion of the base circle to increase valve opening overlap and cylinder scavenging.

20 Claims, 3 Drawing Sheets

(56) References Cited

U.S. PATENT DOCUMENTS

| | | | | |
|---|---|---|---|---|
| 2014/0137819 | A1 | 5/2014 | McConville et al. | |
| 2014/0373808 | A1* | 12/2014 | Ernest | F02D 13/04 123/321 |

* cited by examiner

CAMSHAFT WITH LOW LIFT DWELL PROFILE AND METHODS FOR OPERATING THE SAME

FIELD OF INVENTION

This invention relates to an internal combustion engines, and more particularly to camshafts with low lift dwell profiles and engine operations with the same.

BACKGROUND

The cylinders of an internal combustion engine include intake and exhaust valves that are opened and closed by operation of one or more camshafts associated therewith. The camshaft typically includes one or more lobes that control the opening and closing profile of the associated intake/exhaust valve. The lobes are typically configured to accelerate the associate valve from its seat and maintain positive velocity until a peak lift of the valve from its seat is achieved.

Cylinder operations of internal combustion engine also involve controlling the timing of the opening and closing of the intake valves and the exhaust valves relative to one another to achieve desired combustion results. For example, opening the intake valve while the exhaust valve is opened during the exhaust stroke of the piston allows scavenging where intake air is drawn into the cylinder to facilitate forcing exhaust out of the cylinder. The ability to open the intake valve for cylinder scavenging is limited by clearance between the piston and valve as the piston approaches or is at top dead center. Therefore, further improvements in this area are needed.

SUMMARY

One embodiment is a unique system that includes a multi-cylinder internal combustion engine configured to operate at least one cylinder with a unique valve lift profile for at least one of the intake and exhaust valves during engine operations to achieve valve opening overlap and cylinder scavenging over a long crank angle duration. The valve is controlled by a cam shaft that includes a cam lobe with a cam lobe profile configured to accelerate the valve a short distance from its seat and then maintain the valve at a constant lift from its seat for a significant crank angle duration before accelerating the valve again to a normal lift profile. Longer crank angle durations of overlap in the opening of the intake and exhaust valves can thus be achieved while avoiding the concern of valve and piston clearance associated with a nominal valve lift profile.

Another embodiment includes a camshaft having a base circle with a low lift, constant dwell portion and a main lobe protruding from the base circle to create the two valve opening profiles. In a further embodiment, the crank angle duration in which the valve is open includes both top dead center positions of the piston during an engine cycle. Methods and apparatus employing the unique cam lobe profile are also contemplated.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
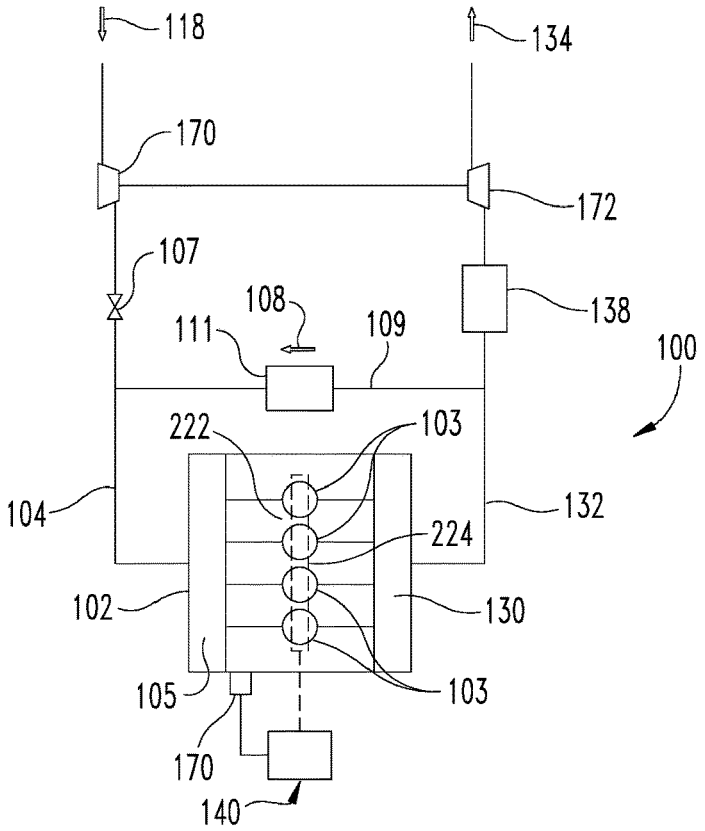
FIG. 1 is a diagrammatic view of an internal combustion engine system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referencing FIG. 1, a system 100 is depicted having an engine 102. The engine 102 is an internal combustion engine of any type, and can include a stoichiometric engine, a diesel engine, a gasoline engine, an ethanol engine, and/or a natural gas engine. In certain embodiments, the engine 102 includes a lean combustion engine such as a lean burn gasoline engine, or a diesel cycle engine. In certain embodiments, the engine 102 may be any engine type producing emissions that may include an exhaust gas recirculation (EGR) system, for example to reduce $NO_x$ emissions from the engine 102. The engine 102 includes a number of cylinders 103. The number of cylinders 103 may be any number suitable for an engine. In the illustrated embodiment, the system 100 includes an inline 4 cylinder arrangement for illustration purposes, but V-shaped arrangements and other numbers of cylinders are also contemplated.

Figure 2:
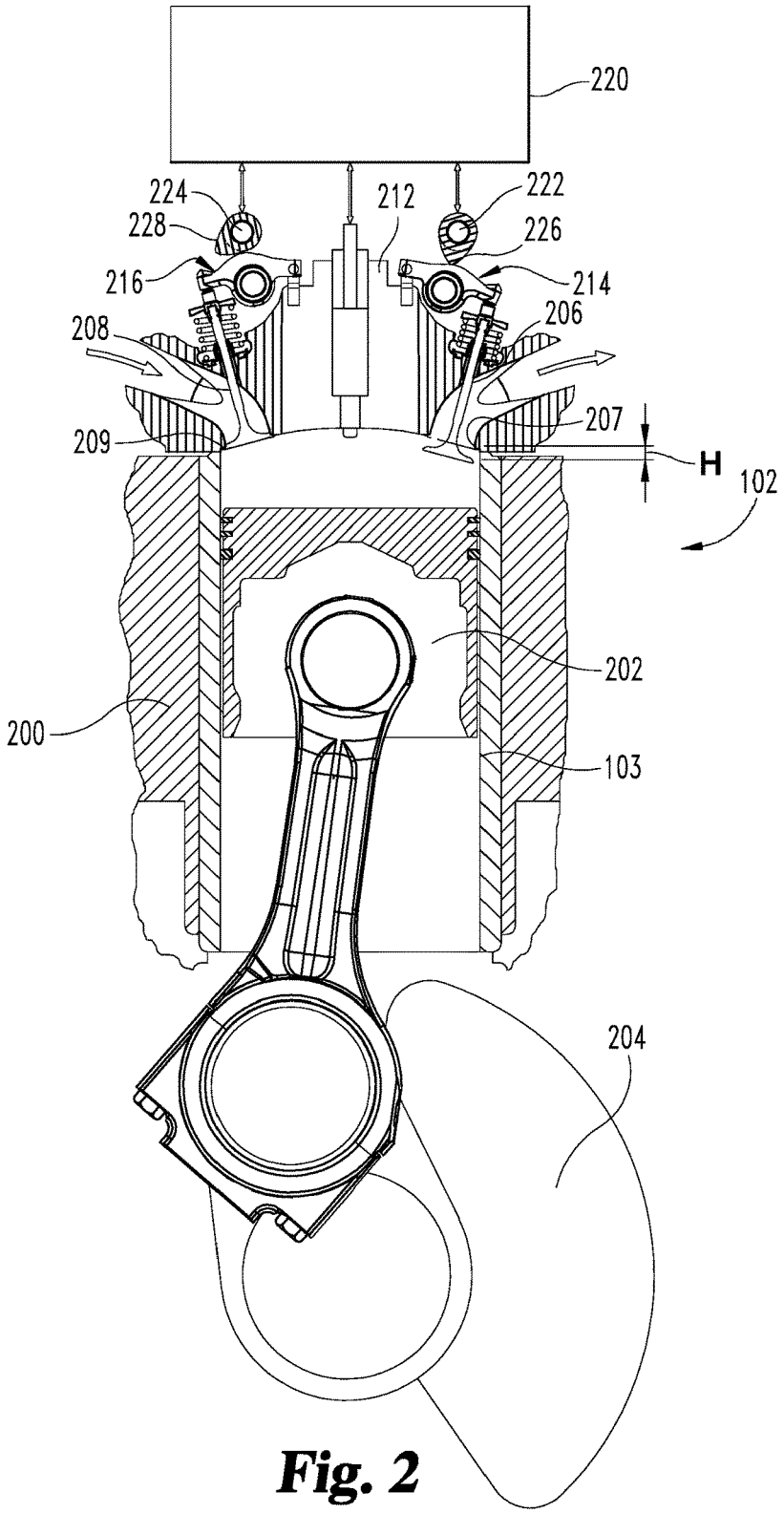
FIG. 2 is a transverse cross-sectional view of a portion of the engine of FIG. 1 having a cam-actuated valve train.

Referring further to FIG. 2, a typical multi-cylinder engine 102 has an engine block 200 with multiple cylinders 103, and a piston 202 in each cylinder that is operably attached to a crankshaft 204. There is also at least one intake valve 206 and at least one exhaust valve 208 that allow passage of air and/or exhaust into and out of each cylinder 103. A combustion chamber 210 is formed inside each cylinder 103. The typical engine 102 operates on a four-stroke cycle that sequentially includes an air intake stroke, a compression stroke, a power stroke, and an exhaust stroke. As used herein, one cycle of the cylinder or engine occurs at the completion of these four strokes.

Referring back to FIG. 1, in the system 100 exhaust flow 134 produced by cylinders 103 is provided to an exhaust manifold 130 and outlet to an exhaust passage 132. System 100 may include and exhaust gas recirculation (EGR) passage 109 to provide an EGR flow 108 that combines with an intake flow 118 at intake manifold 105 or at a position upstream of an intake manifold 105 (as shown). Intake manifold 105 provides a charge flow including the intake flow 118 and, if provided, with EGR flow 108 to cylinders 103. Intake manifold 105 is connected to an intake passage 104 that may include an intake throttle 107 to regulate the charge flow to cylinders 103. Intake passage 104 may also include a charge air cooler (not shown) to cool the charge flow provided to intake manifold 105. Intake passage 104 may also include an optional compressor 170 to compress the intake air flow received from an intake air cleaner (not shown.)

The EGR flow 108 may combine with the intake flow 118 at an outlet of EGR passage 109, at a mixer, or by any other arrangement. In certain embodiments, the EGR flow 108 returns to the intake manifold 105 directly. In the illustrated embodiment, EGR flow 108 mixes with the intake flow 118 downstream of throttle 107 so that exhaust pressure on cylinders 103 is closely aligned with intake pressure, which reduces pumping losses through cylinders 103. In other embodiments, EGR passage 109 can include an EGR cooler 111 and a bypass (not shown) with a valve that selectively allows EGR flow to bypass the EGR cooler 111. The presence of an EGR cooler and/or an EGR cooler bypass is optional and non-limiting.

Cylinders 103 are connected to an exhaust system that includes exhaust manifold 130 that receives exhaust gases in the form of exhaust flow 134 from cylinders 103 and exhaust passage 132 that receives exhaust gas from exhaust manifold 130. In other embodiments, a turbocharger is provided that includes a turbine 172 in exhaust passage 132 that is operable via the exhaust gases to drive compressor 174 in intake passage 104. Exhaust passage 132 includes an aftertreatment system 138 upstream and/or downstream of turbine 172 in exhaust passage 132 that is configured to treat emissions in the exhaust gas. In one embodiment, aftertreatment system 138 includes a catalyst, such as a selective catalytic reduction catalyst or a three-way catalyst. Other embodiments contemplate an exhaust throttle (not shown) in the exhaust passage 132.

In certain embodiments, the system 100 includes a controller 140 structured to perform certain operations to control operations of engine 102. In certain embodiments, the controller 140 forms a portion of a processing subsystem including one or more computing devices having memory, processing, and communication hardware. The controller 140 may be a single device or a distributed device, and the functions of the controller 140 may be performed by hardware or instructions encoded on a computer readable medium that is non-transitory. The controller 140 may be included within, partially included within, or completely separated from an engine controller (not shown). The controller 140 is in communication with any sensor or actuator throughout the system 100, such as engine sensors 170, including through direct communication, communication over a datalink, and/or through communication with other controllers or portions of the processing subsystem that provide sensor and/or actuator information to the controller 140.

In certain embodiments, the controller 140 can functionally executing certain operations. The descriptions herein including the controller operations emphasizes the structural independence of the controller, and illustrates one grouping of operations and responsibilities of the controller. Other groupings that execute similar overall operations are understood within the scope of the present application. Aspects of the controller may be implemented in hardware and/or by a computer executing instructions stored in non-transient memory on one or more computer readable media, and the controller may be distributed across various hardware or computer based components.

Example and non-limiting controller implementation elements include sensors 170 providing any value determined herein, sensors 170 providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

The listing herein of specific implementation elements is not limiting, and any implementation element for any controller described herein that would be understood by one of skill in the art is contemplated herein. The controllers herein, once the operations are described, are capable of numerous hardware and/or computer based implementations, many of the specific implementations of which involve mechanical steps for one of skill in the art having the benefit of the disclosures herein and the understanding of the operations of the controllers provided by the present disclosure.

Certain operations described herein include operations to interpret or determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Referring to FIG. 2, the present system 100 may include a valve actuation mechanism 220 that is configured to provide or switch between various lift profiles for and/or deactivation of the opening and closing intake and exhaust valves 206, 208 of one or more of the cylinders 103 in response to engine operation conditions and/or commands from controller 140. Valve actuation mechanism 220 can include hardware mounted in a head 212 of engine 102 such as valve opening and closing mechanisms 214, 216 and control algorithms that are internal to the controller 140. The valve actuation mechanism 220 also comprises a hydraulic subsystem (not shown) that supplies pressurized oil from an engine oil pump (not shown) to each valve opening mechanism 214, 216. In one embodiment, the valve opening mechanism 214, 216 is comprised of a lifter (not shown) and a locking pin mechanism (not shown) that is inserted between the camshaft 222, 224 and each valve 206, 208.

A typical valve train is comprised of the camshafts 222, 224 (or in another embodiment a single cam shaft) and the plurality of valves 206, 208 that are normally closed and are spring-mounted in the head 212. A valve train is operable to open the plurality of exhaust valves 208, the plurality of intake valves 206, or both, depending upon the engine design. The camshaft 222, 224 is a long rod that is mounted in the engine 102 and rotates around its longitudinal axis. Each camshaft 222, 224 has a cam 226, 228, respectively, that corresponds to one of the valves 206, 208.

Cams 226, 228 are typically cut into the respective camshaft 222, 224 such that they are eccentric to the axis of rotation of the respective cam shaft 222, 224. Each cam 226, 228 has an eccentric portion and a portion that is concentric to the longitudinal axis, the concentric portion also being referred to as the cam base circle. Each cam 226, 228 is in physical contact with the respective valve opening mechanism 214, 216, which is comprised of a lifter and a locking pin mechanism. The valve opening mechanism 214, 216 is in physical contact with each valve 206, 208. The rotation of the camshaft 222, 224 causes each valve 206, 208 to open from its respective seat 207, 209 when the position of the camshaft is such that the eccentric portion of the lobe is in contact with the respective valve opening mechanism 214, 216. In FIG. 2, valve 206 is shown lifted from seat 207 by a distance corresponding to a first height H, and valve 208 is positioned against its seat 209. However, it should be understood that both valves 206, 208 can be lifted from their respective seat simultaneously to provide an overlap in valve opening.

Figure 3:
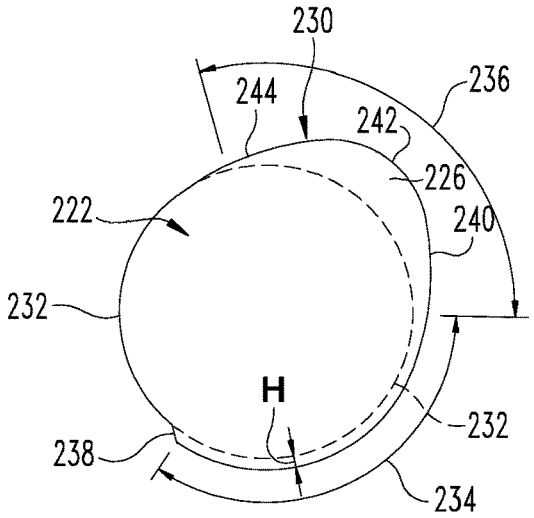
FIG. 3 is a cross-sectional view of a camshaft having an intake cam profile according to the present invention.

Referring to FIG. 3, there is shown a cam lobe profile 230 according to the invention for cam 226 of camshaft 222 for intake valve 206, it being understood that cam lobe profile 230 can alternatively or additionally be provided with cam 228 of camshaft 224 for exhaust valve 208. The cam profile 230 includes a base circle portion 232 that lies on the base circle of cam 228. A low lift dwell portion 234 protrudes from base circle portion 232 and extends at first height H from the base circle, Low lift dwell portion 234 extends continuously at first height H to the main cam lobe portion 236, and there is no cam portion between base circle portion 232 and low lift dwell portion 234 that is greater than first height H. A first lift curve 238 provides the initial lift and acceleration of the valve 206 from its seat 207 to first height and the second lift curve 240 provides a lift of the valve 206 from first height H to a second, substantially greater height at the apex 242 of main cam lobe portion 236. A closing curve 244 extends from apex 242 to base circle portion 232.

Valve 206 is on its seat 207 when base circle portion 232 is in contact with valve opening mechanism 214. The first lift curve 238 accelerates valve 206 from its valve seat 207 to first height H at low lift dwell portion 234 so that valve 206 is spaced a first constant distance from the valve seat 207 along low lift dwell portion 234. The main cam lobe portion 236 has a second height from the base circle that is greater than first height H. Main cam lobe portion 236 provides a relatively larger valve lift of the valve 206 from the valve seat 207 during the engine cycle than does low lift dwell portion 234. When cam profile 230 is applied to a cam for opening an exhaust valve, the low lift dwell portion 234 is arranged after the main cam lobe portion to extend the closing event of the exhaust valve with a low lift dwell profile that increase valve opening overlap and cylinder scavenging. The curve 238 is provided to seat the exhaust valve.

In an exemplary embodiment of the cam profile 230, the base circle portion 232. extends for less than 160 degrees between the main cam lobe portion 236 and the low lift dwell portion 234. The low lift dwell portion 234 extends for more than 90 degrees, and the main cam lobe portion 236 extends for about 110 degrees. In one embodiment, the low lift dwell portion 234 extends for more than 120 degrees around cam profile 230. In another embodiment, the low lift dwell portion 234 extends for more than 180 degrees around cam profile 230. In any embodiment, the low lift dwell portion 234 is a constant height from the base circle portion 232 to the main cam lobe portion 236.

In an exemplary cam profile 230, the height of the main cam lobe portion 236 provides approximately 25-30 mm of associated intake valve lift at apex 242. However, the valve lift height provided by the main cam lobe portion 236 can be varied to suit the application. The height H of the low lift dwell portion 37 may vary in a range from 0.25 mm to 3 mm. Other heights H are contemplated depending on the space available for clearance between the respective valve 206, 208 and piston 202 at top dead center so that the low lift dwell profile 234 can lift the respective valve 206, 208 from its seat when piston 202 is at top dead center. It should be understood these values are exemplary only and can be varied to suit the particular conditions of a particular engine embodiment.

Figure 4:
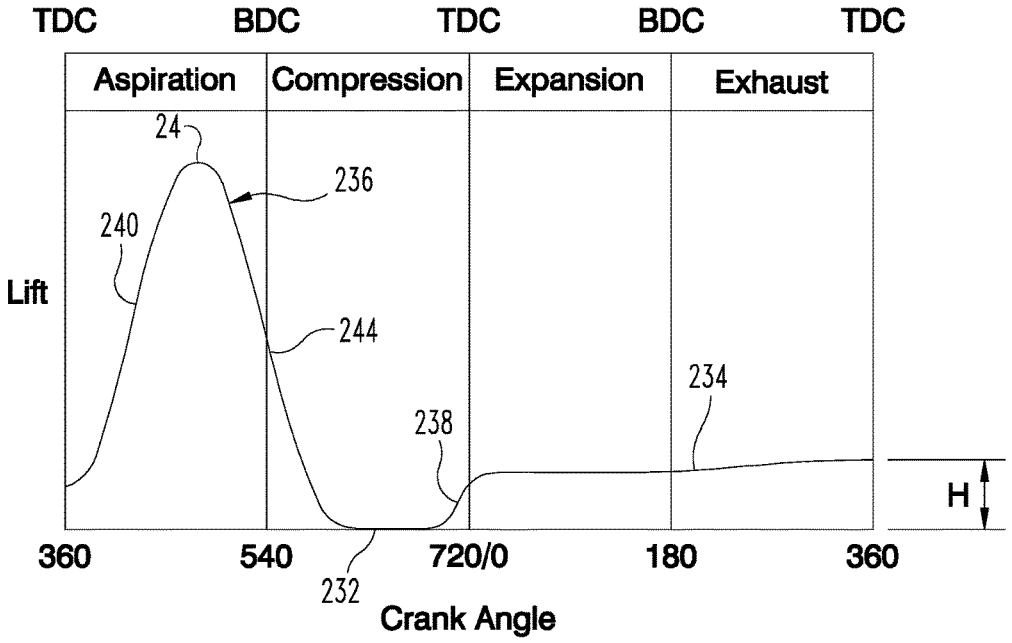
FIG. 4 is a graph showing intake valve lift during exhaust and intake portions of an engine cycle.

FIG. 4 is a graph of valve lift versus cam angle for the exemplary cam profile 230 of FIG. 3 during an engine cycle. Portions of the lift curve that correspond to portions of the cam profile 230 are designated with the corresponding reference numerals of cam profile 230, FIG. 4 is directed to a cam profile 230 provided on an intake valve 206, it being understood that an analogous cam profile can be provided on exhaust valve 208. In this graph, the low lift dwell portion 234 allows the intake valve 206 to be opened before top dead center of the piston 202 at the start of the expansion stroke and remain open until after top dead center at the start of the aspiration stroke, encompassing both top dead cente positions of piston 202. This increases the overlap in opening of the intake valve with the exhaust valve and improves cylinder scavenging. When provided for operation of exhaust valve 208, the low lift dwell portion 234 allows the exhaust valve 208 to be opened before top dead center of the piston 202. at the start of the aspiration stroke and remain open until after top dead center at the start of the expansion stroke, encompassing both top dead center positions of piston 202.

Various aspects of the present invention are contemplated. On aspect includes a camshaft arrangement for opening a valve of an engine. The camshaft arrangement includes a cam defining a cam lobe profile that consists of a base circle portion on a base circle of the cam lobe, a low lift dwell portion, and a main cam lobe portion. The low lift dwell portion extends a first height from the base circle and the first height is constant along the low lift dwell portion. The first height defines the maximum height of the cam profile other than at the main cam lobe portion, and the low lift dwell portion is configured so that the valve is lifted from a seat by a distance corresponding to the first height that is sufficient for scavenging during an engine cycle, and the valve is maintained at the distance from the seat along the entire low lift dwell portion. The main cam lobe portion lies adjacent to the low lift dwell portion and extends a second height above the base circle portion at an apex of the main cam lobe portion to fully lift the valve from the seat during the engine cycle.

In one embodiment, the low lift dwell portion has an angular extent of at least 180 degrees of the cam lobe profile. In a refinement of this embodiment, the base circle portion has an angular extent of less than 80 degrees around the cam lobe profile. In a further refinement, the main cam lobe portion has an angular extent ranging from 80 degrees to 160 degrees around the cam lobe profile.

In another embodiment, the first height ranges from 0.25 mm to 3 mm. In yet another embodiment, the low lift dwell portion transitions from the base circle portion with a first lift curve and the main cam lobe portion transitions from the low lift dwell portion to the apex along a second lift curve. In a refinement of this embodiment, the main cam lobe portion transitions from the apex to the base circle portion along a closing curve. In a further embodiment, the low lift dwell portion extends between and overlaps each of the top dead center positions of a piston associated with the valve so that the valve is spaced at the distance from the seat as the piston moves through each of the top dead center positions.

The camshaft arrangement can be provided with an engine system including any one or more of a turbocharger, EGR system, and aftertreatment system. Methods for lifting the exhaust valve from its seat can be performed by rotating the camshaft to actuate the valve according to the cam lobe profile disclosed herein.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A camshaft arrangement for opening an intake valve of an engine, comprising:

an intake cam defining a cam lobe profile that consists of a base circle portion on a base circle of the cam lobe, a low lift dwell portion, and a main cam lobe portion, wherein:

the low lift dwell portion extends a first height from the base circle and the first height is constant along the low lift dwell portion, wherein the first height defines the maximum height of the cam profile other than at the main cam lobe portion, and the low lift dwell portion is configured so that the intake valve is lifted from a seat by a distance corresponding to the first height, the low lift dwell portion extends a length along the cam lobe profile to lift the intake valve to draw intake air into a cylinder of the engine to scavenge within the cylinder during both an expansion stroke and an exhaust stroke of an engine cycle, the low lift dwell portion maintains the intake valve at the distance along the entire low lift dwell portion; and the main cam lobe portion lies adjacent to and follows the low lift dwell portion and extends a second height above the base circle portion at an apex of the main cam lobe portion to fully lift the intake valve from the seat during the engine cycle.

2. The camshaft arrangement of claim 1 wherein the low lift dwell portion has an angular extent of at least 180 degrees around the cam lobe profile.

3. The camshaft arrangement of claim 2, wherein the base circle portion has an angular extent of less than 80 degrees around the cam lobe profile.

4. The cam shaft arrangement of claim 3, wherein the main cam lobe portion has an angular extent ranging from 80 degrees to 160 degrees around the cam lobe profile.

5. The camshaft arrangement of claim 1, wherein the first height ranges from 0.25 mm to 3 mm.

6. The camshaft arrangement of claim 1, wherein the low lift dwell portion transitions from the base circle portion with a first, lift curve and the main cam lobe portion transitions from the low lift dwell portion to the apex along a second lift curve.

7. The camshaft of arrangement of claim 6, wherein the main cam lobe portion transitions from the apex to the base circle portion along a closing curve.

8. The camshaft arrangement of claim 1, wherein the low lift dwell portion extends between and overlaps each top dead center position of a piston associated with the cylinder so that the intake valve remains spaced at the distance from the. seat as the piston moves through each of the top dead center positions of the piston during the engine cycle.

9. The camshaft arrangement of claim 1, wherein the intake cam is included with an internal combustion engine system that includes the engine with a plurality of cylinders and a turbocharger.

10. The camshaft arrangement of claim 9, wherein the internal combustion engine system includes an exhaust gas recirculation system.

11. A camshaft arrangement for opening an exhaust valve of an engine, comprising:

an exhaust cam defining a cam lobe profile that consists of a base circle portion on a base circle of the cam lobe, a low lift dwell portion, and a main cam lobe portion, wherein:

the low lift dwell portion extends a first height from the base circle and the first height is constant along the low lift dwell portion, wherein the first height defines the maximum height of the cam profile other than at the main cam lobe portion, and the low lift dwell portion is configured so that the exhaust valve is lifted from a seat by a distance corresponding to the first height, the low lift dwell portion extends a length along the cam lobe profile that is sufficient for scavenging within a cylinder of the engine during both an air intake stroke and a compression stroke of an engine cycle and the exhaust valve is maintained at the distance along the entire low lift dwell portion; and the main cam lobe portion lies adjacent to and precedes the low lift dwell portion and extends a second height above the base circle portion at an apex of the main cam lobe portion to fully lift the exhaust valve from the seat during the engine cycle.

12. The camshaft arrangement of claim 11, wherein the low lift dwell portion has an angular extent of at least 180 degrees around the cam lobe profile.

13. The camshaft arrangement of claim 12, wherein the base circle portion has an angular extent of less than 80 degrees around the cam lobe profile.

14. The cam shaft arrangement of claim 13, wherein the main cam lobe portion has an angular extent ranging from 80 degrees to 160 degrees around the cam lobe profile.

15. The camshaft arrangement of claim 11, wherein the first height ranges from 0.25 mm to 3 mm.

16. The camshaft arrangement of claim 11, wherein the main cam lobe portion transitions from the base circle portion with a lift curve and the low lift dwell portion transitions from the main cam lobe portion to the apex along a first closing curve.

17. The camshaft of arrangement of claim 16, wherein the low lift dwell portion transitions to the base circle portion along a second closing curve.

18. The camshaft arrangement of claim 11, wherein the low lift dwell portion extends between and overlaps each top dead center position of a piston associated with the cylinder so that the exhaust valve remains spaced at the distance from the seat as the piston moves through each of the top dead center positions of the piston during the engine cycle.

19. The camshaft arrangement of claim 11, wherein the exhaust earn is included with an internal combustion engine system that includes the engine with a plurality of cylinders and a turbocharger.

20. The camshaft arrangement of claim 19, wherein the internal combustion engine system includes an exhaust gas recirculation system.

* * * * *